United States Patent [19]

Bolte

[11] Patent Number: 4,693,801

[45] Date of Patent: Sep. 15, 1987

[54] METHOD OF DECORATING AND INHIBITING CORROSION OF METALLIC ARTICLES

[75] Inventor: Georg Bolte, Vechelde, Fed. Rep. of Germany

[73] Assignee: Schmalbach-Lubeca AG, Brunswick, Fed. Rep. of Germany

[21] Appl. No.: 753,317

[22] Filed: Jul. 9, 1985

[30] Foreign Application Priority Data

Jul. 11, 1984 [DE] Fed. Rep. of Germany ..... 3425435

[51] Int. Cl.[4] ..... C25D 13/14

[52] U.S. Cl. ..... 204/180.2; 204/38.7

[58] Field of Search ..... 204/180.2, 180.7, 38.7

[56] References Cited

U.S. PATENT DOCUMENTS

| | | | |
|---|---|---|---|
| 4,066,038 | 2/1979 | Shutie et al. . | |
| 4,094,760 | 6/1978 | Smith et al. | 204/180.7 |
| 4,210,507 | 7/1980 | Davidson et al. | 204/180.7 |
| 4,246,088 | 1/1981 | Murphy et al. | 204/180.7 |
| 4,400,251 | 8/1983 | Heffner et al. | 204/180.7 |
| 4,400,252 | 8/1983 | Vshijima | 204/38.7 |
| 4,522,691 | 6/1985 | Suginoya et al. | 204/38.7 |
| 4,529,492 | 7/1985 | Buchholz et al. | 204/180.7 |

FOREIGN PATENT DOCUMENTS

| | | |
|---|---|---|
| 1947988 | 9/1969 | Fed. Rep. of Germany . |
| 2024106 | 5/1970 | Fed. Rep. of Germany . |
| 2726732 | 6/1977 | Fed. Rep. of Germany . |
| 0033140 | 1/1981 | Fed. Rep. of Germany . |
| 3314776 | 4/1983 | Fed. Rep. of Germany . |
| 1558464 | 7/1975 | United Kingdom . |

OTHER PUBLICATIONS

Der Blechdruck (article)-Fachhochschule für Druck Stuttgart.

Lackrohstofftabellen-Dr. Erich Karsten (Bearb. Olaf Lückert).

Lexikon Für Die Graphische Industrie-(Schmalbach-Lubeca GmbH) (Ernst Born), 1972.

Glasurit-Handbuch Lacke und Farben-Curt R. Vincentz Verlag, Hannover, 1984.

*Primary Examiner*—John F. Niebling

*Assistant Examiner*—Terryence Chapman

*Attorney, Agent, or Firm*—Karl F. Ross; Herbert Dubno

[57] ABSTRACT

A decor is applied to a tin can by printing a pattern onto a metallic surface thereof directly and hardening the pattern on the metallic surface. The can is then immersion-coated in an electroimmersion lacquering unit to provide it with a lacquer coating. The printed pattern can be an electrically conductive lacquer in order to insure the electroimmersion coating of the printed pattern as well as the exposed metal surfaces which may surround it.

2 Claims, 2 Drawing Figures

METHOD OF DECORATING AND INHIBITING CORROSION OF METALLIC ARTICLES

FIELD OF THE INVENTION

The present invention relates to a method of decorating and inhibiting corrosion with respect to metallic articles and particularly tin-coated or tin-plated articles, such as the external surfaces of cans or the like which may be used for beverages and comestibles.

BACKGROUND OF THE INVENTION

It is known, especially for packaging containers such as tin-plated cans, to provide a decorative pattern upon the external surface and, of course, to protect internal and external surfaces against corrosion by the application of anticorrosion coatings. Both are particularly important when the container, e.g. a can is to be used for the packaging of comestibles or beverages.

The reference to a "decorative" pattern contained herein will be understood to include patterns which are informative, i.e. printed information, patterns which are merely esthetic (e.g. decorations or illustrations) and patterns which are a hybrid of the two, i.e. printed information associated with color fields to enhance certain information. The information which may be encompassed may include the name and address of manufacture, information regarding the source of and nature of the product and consumer information, data or data required by law to be associated with packaging which may reach hands of consumers.

In the past, the application of a decor or pattern upon the outer periphery of the can and the coating of the external surface with a lacquer was carried out in practice by the following sequence of steps:

(a) preparation of the surface of the can and the coating thereof with a lacquer to serve as a ground coat for the decor to be subsequently applied;

(b) drying and/or cross-linking the ground lacquer or primer;

(c) application of the decor or print to the primer on the outer surface of the can;

(d) drying and/or cross-linking or curing of the printed pattern;

(e) spraying the bottom with a lacquer or corrosion protection;

(g) spraying the interior of the can with a lacquer as a corrosion-preventing coating;

(g) drying and/or cross-linking or curing of the anticorrosion lacquers.

When two-part or two-layer lacquer coatings are required, each additional lacquer application step generally requires two distinct operations, for example, a further internal spray lacquering and an additional drying or cross-linking operation.

The very large number of steps required to apply decorative patterns and anticorrosion coatings to metallic articles such as tin cans, requires comparably complex and expensive equipment and a comparatively long process line. Indeed, the earlier technique also requires comparatively large amounts of lacquer since in the application of the lacquer, variations in the coating thickness cannot be avoided and narrow tolerances cannot be maintained so that in many cases considerably greater thickness of the lacquer coating must be employed to ensure effective anticorrosion protection above the minimum thickness layer which is required.

This also applies to the primer-lacquer or ground-lacquer coating to the extent that this coating is not covered by the print or pattern.

OBJECTS OF THE INVENTION

It is the principal object of the present invention to provide a method of protecting a metallic object against corrosion and applying a decor or print to the object whereby disadvantages of earlier techniques are avoided.

Another object of this invention is to provide a method for these purposes which can markedly reduce the number of process steps and also the size and cost of the apparatus for carrying them out, and reduce the labor cost associated with anticorrosion protection adn printing of metal objects such as tin-plated or tin-coated cans.

Still another object of this invention is to provide a method which reduces the amount of the lacquer material which is used.

SUMMARY OF THE INVENTION

These objects and others which will become apparent hereinafter are attained, in accordance with the invention, in a method whereby the decor print is applied to the outer surface of the can directly and is covered with a corrosion-resistant coating of a lacquer through which the print is visible by electroimmersion coating followed by drying and/or cross-linking of the immersion-applied lacquer.

Electroimmersion lacquering for the coating of metallic hollow bodies has been described especially in connection with the automobile industry and has also been indicted in conjunction with the application of a coating upon a can body in German patent document-open German DE-OS 20 24 106.

In this earlier system, the can body receives a coating of corrosion-resistant lacquer by immersion of the can body formed as a three-part can after the fabrication of the body but before it has been provided with a bottom and filled. There is no indication as to how a decorative print could be applied or even any indication as to whether a decorative print is applied. It is therefore possible to conclude only that any such decorative print would have to be applied to the corrosion-resistant lacquer coating which clearly would involve significant difficulty, e.g. with respect to damage to the coating because of mechanical stress in the printing operation or problems with effective printing.

All problems with respect to the effectiveness of the coating operation after printing are eliminated when the postprinting is effected by electroimmersion lacquering in a single operation whereby the coating is applied to all surfaces of the metal which have not previously been printed and, of course, to the printed pattern.

This allows the lacquer coating to be applied in the desired minimum thickness but provides an increase in the coating thickness at corners or edges to enhance the corrosion-protective effect.

The system of the invention, therefore, completely eliminates the need for a primary or ground lacquer coating which in the past was used to provide a suitable base for the print and could contribute a background color or assist in preventing running of the print regions into one another.

With the present invention, the print is applied in one or more color fields to the metallically clean outer surface of the can and is hardened, the thus printed decorated can being coated with the corrosion-resistant lacquer by the electroimmersion lacquering step as previously described and simultaneously therewith the decorative pattern can be completed or complemented. The optical complementing of the pattern can be effected through the use of pigmented or even nonpigmented lacquers.

The pigmentation of the corrosion-resistant lacquer can be effected as color pigments of a type which have been used heretofore in the primer-lacquer coating required in earlier systems. This technique can be employed to impart to the regions between printed zones a desired color hue so that between this colored hue and the print, the desired decor is imparted to the can.

Since the electroimmersion coating requires a transfer of lacquer from the solution to the can and the passage of electric current between the can and the counterelectrode, it is dependent upon the electrical conductivity between the can and the counterelectrode. The lacquer layer in effect forms a resistance within this path. As a result in operation there is a sharp reduction in the transfer of lacquer of the can to limit the coating thickness but at the same time one can be certain that there will be no region which remains uncoated to form a site at which corrosion may be initiated.

The decorative print can include one or more colored surfaces or zones and can be in the form of images, letters, numbers or the like and the printing can be effected in one or more printing passes.

One of the important advantages of the invention by comparison with the process previously described, is that only four process steps are required, namely, printing the decorative pattern in one or more colors, hardening the decorative pattern, electroimmersion and lacquering and hardening the immersion-applied lacquer.

According to a feature of the invention, the decorative pattern is applied utilizing an electrically conductive lacquer which contains a pigment or coloring agent for each of the colors to be printed, whereupon the entire outer surface of the can is coated with a clear (transparent) lacquer completely by the electroimmersion lacquering.

The method of the invention has been found to be especially advantageous for the fabrication of decorated and printed cans whose outer surfaces may undergo paarticularly stressful later handling. The protective layer which is applied has been found to be effective in preventing significant damage to the decorative print and of course provides the necessary corrosion resistance even for those regions which are not printed.

The various color fields can be separated by blank or metallically clean spaces when the print is applied and when the entire outer surface is then covered by the electroimmersion lacquering with clear lacquer after hardening of the decorative print.

The amount of lacquer which is applied in total by the method of the invention is substantially less than the amount of lacquer hitherto required for tin cans printed and fabricated in accordance with the conventional techniques.

BRIEF DESCRIPTION OF THE DRAWING

The above and other objects, features and advantages of the present invention will become more readily apparent from the following description, reference being made to the accompanying drawing in which.

SPECIFIC DESCRIPTION AND EXAMPLE

Figure 1:
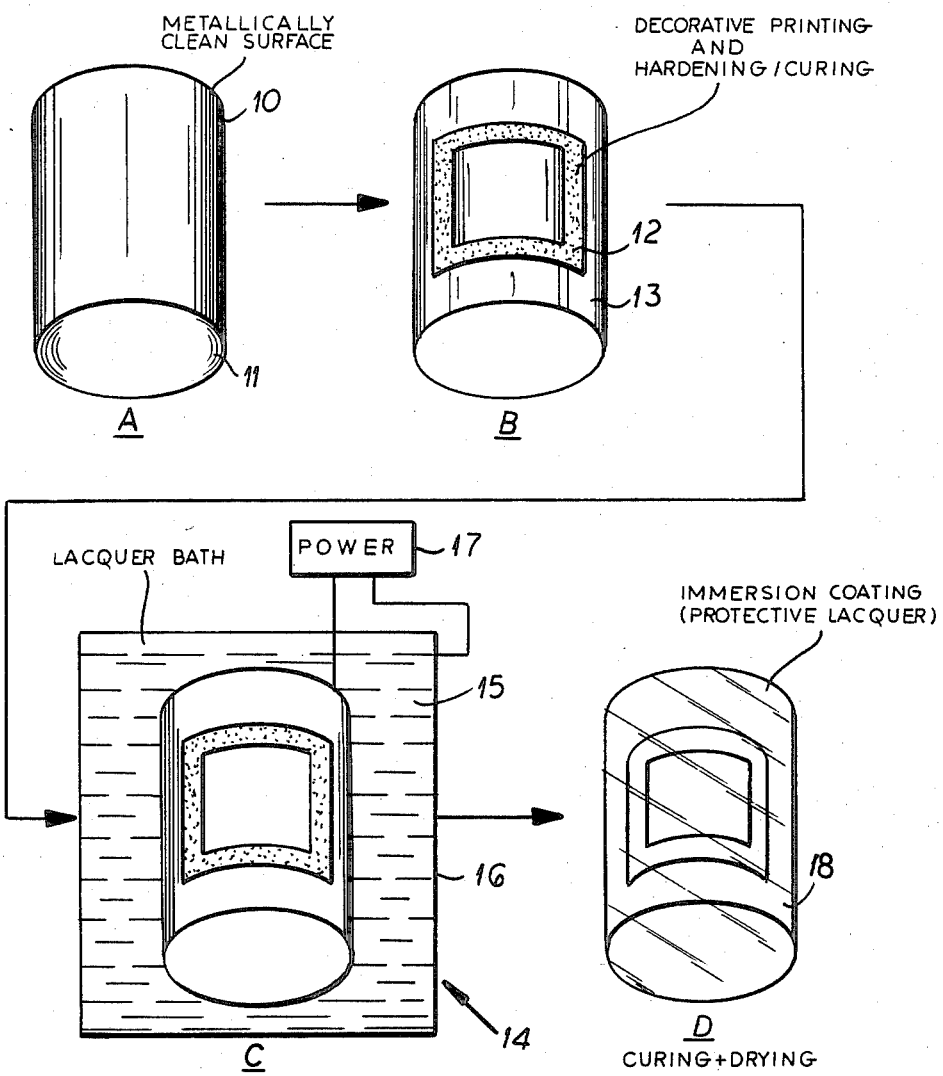
FIG. 1 is a diagram showing the successive steps in carrying out the process of the present invention.

A metallically clean can (step a) with a cylindrical surface 10 and a closed bottom 11 is subjected as shown in step b to decorative printing and hardening/curing. The pattern, here shown solely for the sake of illustration has a rectangular frame 12 is composed of an electrically conductive lacquer which contains a pigment contrasting with the metal surface 13 of the can.

After the lacquer print 12 has been hardened, the can is immersed in an electroimmersion lacquering apparatus as represented at 14 and including a bath 15 containing lacquer particles which are electrophoretically attracted to the surfaces of the can and the conductive print, under the effect of an electric field created between the can and the counterelectrode 16 forming the vessel from the power supply 17.

The immersion-coated protective lacquer is seen at 18 in step d.

Figure 2:
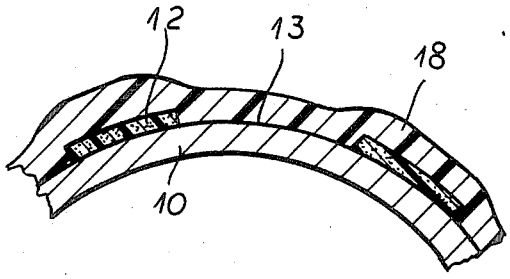
FIG. 2 is a diagrammatic cross section through a portion of a tin can to which the method of the invention has been applied.

In the cross section of FIG. 2, where thicknesses have been greatly exaggerated, it can be seen that the decorative print 12 is appplied directly to the metallically clean surface 13 of the can 10 and that the lacquer coating 18 covers all of the outer surfaces and bottom of the can.

The printing utilizing the conductive lacquer is effected by any conventional can printing technique and the electroimmersion coating is carried out as described in the German patent document previously mentioned.

I claim:

1. A method of applying a decor and protecting against corrosion, the outer curved surface of a metal can which comprises the steps of:

(a) initially printing directly on the curved outer surface of a metal can at least one decorative field of at least one color to form a decorative pattern on a metallic surface of the can;

(b) hardening the printed pattern by drying and cross-linking on said metallic surface; and (e) thereafter completely coating the curved surface of the can and the decorative pattern imposed thereon by electroimmersion lacquering and simultaneously completing a pattern to be applied to the can at least in part by a contribution to the printed pattern of the coating applied by electroimmersion lacquering.

2. The method defined in claim 1 wherein the printed pattern applied in step (a) is composed of an electrically conductive lacquer and the electroimmersion lacquering is effected at least in part by a transparent lacquer.

* * * * *